United States Patent [19]

Hartley et al.

[11] Patent Number: 4,805,652

[45] Date of Patent: Feb. 21, 1989

[54] WASH STATION FOR TANKS

[75] Inventors: Larry D. Hartley; Duane R. Greenquist, both of Beatrice, Nebr.

[73] Assignee: Hoover Group, Inc., Roswell, Ga.

[21] Appl. No.: 99,119

[22] Filed: Sep. 21, 1987

[51] Int. Cl.[4] ..... B08B 3/04

[52] U.S. Cl. ..... 134/159; 134/166 R; 134/167 R; 134/171

[58] Field of Search ..... 134/166 R, 167 R, 168 R, 134/169 R, 171, 120, 117–119, 159

[56] References Cited

U.S. PATENT DOCUMENTS

| | | | |
|---|---|---|---|
| 2,716,989 | 9/1955 | Joy | 134/159 X |
| 2,830,605 | 4/1958 | Kleeman et al. | 134/159 X |
| 3,291,144 | 12/1966 | Diamond | 134/170 |
| 3,608,568 | 9/1971 | Hallsworth | 134/120 |
| 4,015,614 | 4/1977 | Jonsson et al. | 134/171 X |
| 4,164,198 | 8/1979 | Sheinin et al. | 134/167 R X |
| 4,537,669 | 8/1985 | McInnes | 134/159 X |
| 4,694,846 | 9/1987 | Bouchard | 134/171 X |

FOREIGN PATENT DOCUMENTS

| | | | |
|---|---|---|---|
| 307104 | 7/1971 | U.S.S.R. | 134/171 |

*Primary Examiner*—Harvey C. Hornsby
*Assistant Examiner*—Stephen F. Gerrity
*Attorney, Agent, or Firm*—Harness, Dickey & Pierce

[57] ABSTRACT

A wash station for receiving, clamping, inverting, and washing a tank and pallet assembly consists of a stationary frame having a pair of idler rollers and a pair of drive rollers, and a rotatable carriage mounted on the rollers. The carriage includes two separate vertical arcuate wheel members resting on the rollers, a transverse tank support platform extending transversely between the wheel members, transverse support struts, horizontal and vertical wheel support members, and a movable hold down clamp with an integral nozzle assembly. The hold down clamp and nozzle assembly is movable to a clamped position engaging a tank and pallet assembly resting on the support platform. When the assembly is clamped, spray nozzles are inserted within the tank. The carriage containing the tanks to be washed is then rotated 180°, inverting the tanks. Wash fluid is then supplied via the spray nozzles into the interior of the tanks. At the completion of a washing operation, the carriage position is reversed and the tank's assembly unclamped, thus allowing the removal of the clean tank and pallet assembly from the carriage.

1 Claim, 2 Drawing Sheets

WASH STATION FOR TANKS

BACKGROUND OF THE INVENTION

This invention relates to container washing facilities and more particularly to a structure for receiving, clamping, rotating, and washing tanks.

Container washing facilities generally consist of an area where liquid tanks and other such containers may be manually washed with soap and water or other solvents, drained, and then manually removed and prepared for receipt of new liquid contents. Efficient handling of these tanks has been enhanced by the introduction of a multiple tank and pallet assembly such as disclosed in U.S. Pat. No. 4,605,126. Prior to the present invention each tank component of such an assembly had to be individually removed from the assembly, washed, and then returned to the pallet. This requires a substantial expenditure of time and labor to wash each tank.

It is an object of the present invention, therefore, to provide a semi-automatic washing station for tank and pallet assemblies similar to those disclosed in the referenced patent, efficiently, and with minimum manual handling required. In addition, it is an object of this invention to provide a method for simultaneously washing all tanks in a single tank and pallet assembly.

SUMMARY OF THE INVENTION

An embodiment of this invention consists of a tank and pallet assembly wash station comprising a stationary frame having two pairs of rollers mounted thereon, one pair being driven by an electric motor, and a carriage resting on these rollers for receiving, securing, rotating, and washing the interior of tanks mounted thereon. The carriage consists of two parallel arcuate frame wheels separated by carriage struts and a support platform connected between the parallel wheels, a horizontal support member passing through the center of the arcuate wheel in the plane of the wheel and connected to the periphery of the wheel, and parallel support members equally spaced from the center of the wheel member and perpendicular to the horizontal support member and connected at both ends to the periphery of the wheel, thus forming an upright arcuate carriage having an open side.

The tank and pallet assembly, when inserted through the open side of the carriage, is supported on the platform and is retained thereon by a rectangular hold down frame centrally disposed between the arcuate wheels. A fluid operated piston and cylinder on either side of the hold down frame is connected between the hold down frame and each horizontal support member at the center of each wheel. Integral with the hold down frame is a header and spray nozzle assembly which directs the spray nozzles into the openings in the tanks as the hold down frame is moved from the unclamped to the clamped position.

A tank and pallet assembly according to this invention is first prepared for washing by removing the fill and vent caps on each tank, attaching quick disconnect fittings to the discharge tubes to allow tube drainage during the wash operation and loading the tank and pallet assembly onto a fork lift.

The fork lift then positions the tank and pallet assembly through the side opening in the carriage onto the support platform and the fork lift is removed. Actuating fluid is then supplied to the fluid operated cylinders which then simultaneously lowers the hold down frame onto the top of the tanks in the tank and pallet assembly and lowers the spray nozzles into the tank openings. The motor is then energized, rotating the carriage and the tank and pallet assembly contained therein until the tank and pallet assembly is inverted.

Washing fluid is then injected through the spray nozzles into the tanks thoroughly washing the tank interiors. The inverted washing position allows the wash water to gravity drain into a conventional drain below the carriage assembly. At the conclusion of the washing cycle the motor is then reversed, rotating the carriage assembly back to the original upright position. The hold down frame is then raised, removing the spray nozzles from the container, and a fork lift then removes and transports the clean tank and pallet assembly from the wash station.

Further objects, features and advantages of this invention will become apparent from a consideration of the following description, the appended claims, and the accompanying drawing in which;

DETAILED DESCRIPTION OF THE PREFERRED EMBODIMENT

Figure 1:
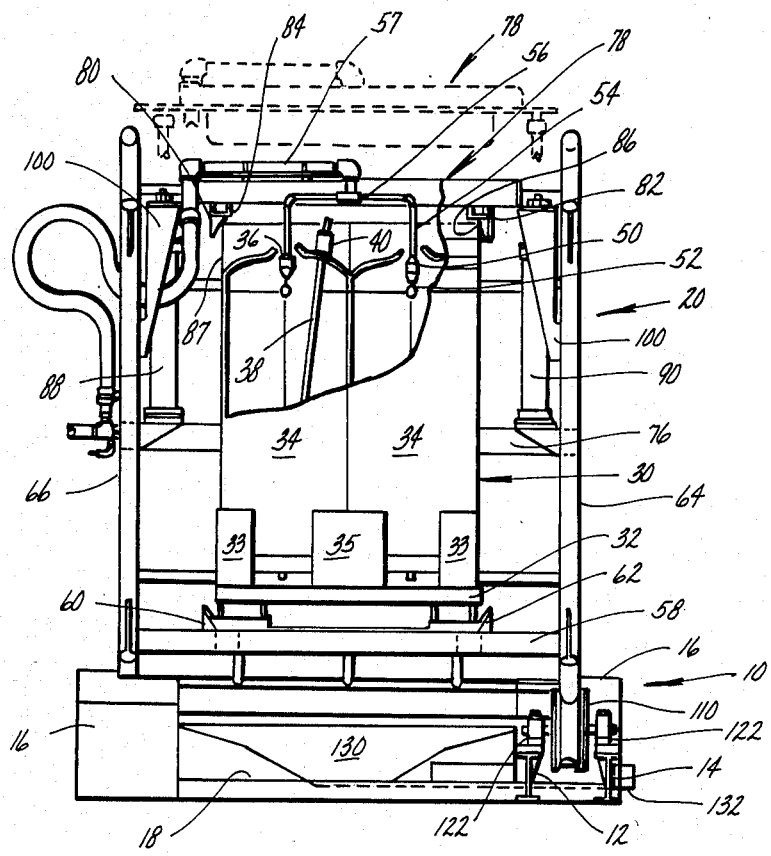
FIG. 1 is a front view of the wash station of the present invention showing a tank and pallet assembly in the clamped position, and with some parts of the tanks broken away to show the spray nozzles positioned within the tanks.

Referring now to the drawings, and specifically to FIG. 1, the wash station of the present invention is shown in front view, with a portion of the tank and pallet assembly broken away to show the insertion of the nozzles within the tank. The wash station of the present invention, in general, comprises a stationary frame 10, and a carriage 20 movably mounted on the stationary frame 10 and supporting a tank and pallet assembly 30 during washing.

The tank and pallet assembly 30 consists of a conventional rectangular pallet 32 having vertical corner tank guides 33 and side tank guides 35 to retain the four tanks 34 in position on the pallet 32. Each tank 34 has a fill and vent opening 36 at the top center of the tank 34 and a discharge tube 38 which extends from the bottom of each tank 34 through the top of each tank 34. Before mounting of the tank and pallet assembly 30 on the carriage 20 for washing, a quick disconnect 40 shown in the cut-away view of the tank and pallet assembly in FIG. 1, is attached to the discharge tube 38. This allows for drainage of tube 38 when the tank and pallet assembly is inverted during the washing operation. The cut-away view of the tanks shown in FIG. 1 shows the insertion of nozzles 50 within the fill and vent openings 36 of each tank 34. Attached to the nozzles 50 are spray heads 52 which direct washing fluid in all directions to thoroughly wash the inside of tank 34. Attached nozzles 50 are supported by vertical nozzle extensions 54 which are in turn connected to each leg of H-shaped wash header 56 made of conventional piping materials.

Figure 2:
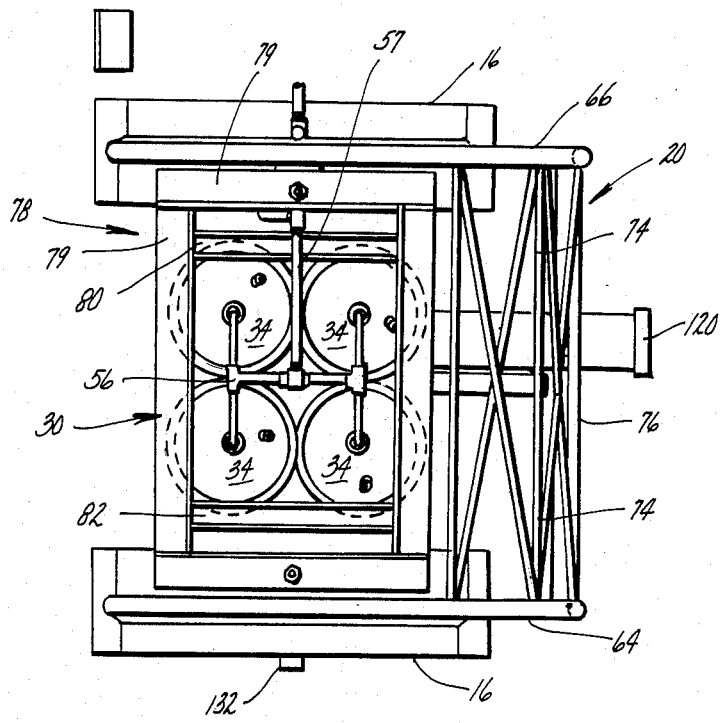
FIG. 2 is a top view of the wash station of the present invention showing a tank and pallet assembly in the clamped position.
Figure 3:
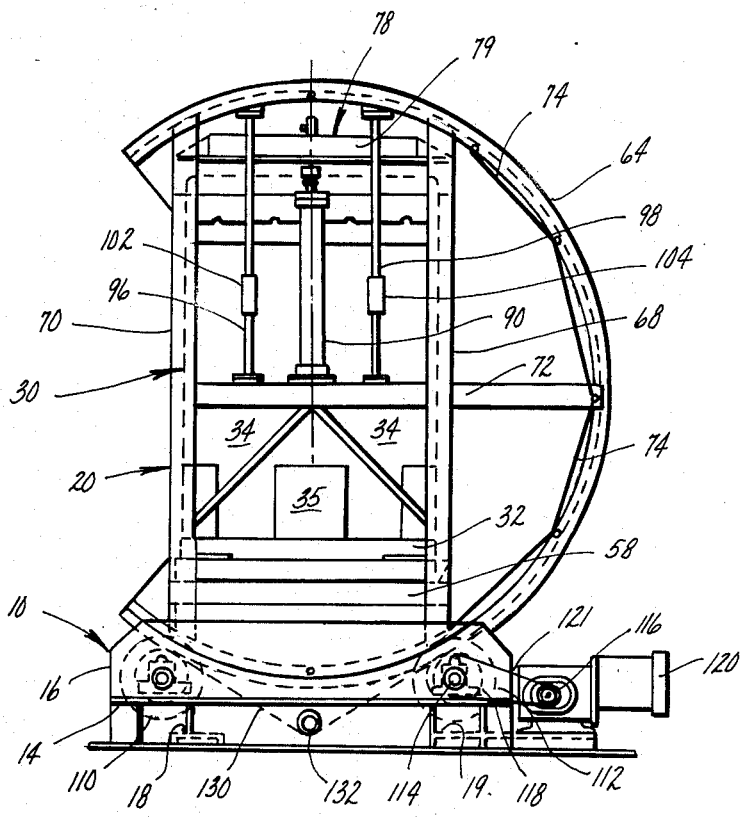
FIG. 3 is a side view of the wash station of the present invention, showing the movable carriage therein in a position to load and unload tank assemblies therefrom.

Tank and pallet assembly 30 is supported within carriage 20 on support pads 60 and 62 which in turn are fixed to a horizontal platform 58 which is secured to and extends between vertical arcuate carriage wheel members 64 and 66. Arcuate wheel members 64 and 66 are maintained in rigid, parallel relation by vertical support members 68 and 70 and horizontal member 72 as shown in FIG. 3 for wheel member 64. In addition, as shown in FIG. 2, parallel separation between wheel members 64 and 66 is maintained by a plurality of transverse struts 74 and horizontal carriage frame member 76 at the rear of the carriage as shown in FIG. 2.

Tank and pallet asembly 30 is held in place on support platform 58 within carriage 20 by hold down clamp assembly 78. Hold down assembly 78 consists of a rectangular frame 79, guide members 80 and 82, and clamping pads 84 and 86 which contact the upper rims of vertical tank wall extensions 87 on the tanks 34.

Hold down clamp 78 is vertically movable between an unclamped position as shown by the dotted lines in FIG. 1, and a clamped position as shown by the solid lines. Header 56 is connected to conventional pipe 57 which is attached to rectangular frame 79. Pipe 57 is in turn connected to flexible hose 55. When the hold down clamp is in the unclamped or raised position as shown by the dotted lines, spray nozzles 50 and spray head 52 are positioned directly above the tank openings 36, to allow insertion and removal of the tank and pallet assembly 30 from carriage 20. When in the lowered or clamped position, hold down clamp 78 directs spray nozzles 50 and spray head 52 within tank openings 36 as illustrated in FIG. 1.

Movement of hold down clamp 78 relative to support platform 58 to clamp tank and pallet assembly 30 within carriage 20 is provided by fluid actuated cylinders 88 and 90 which are rigidly mounted to arcuate wheel members 66 and 64 respectively via horizontal frame members 72 as shown in FIG. 3. Horizontal frame member 72 is fixed to carriage frame members 68, 70 and arcuate wheel member 64 and passes through the center of arcuate wheel member 64. As shown in FIG. 3, the base of cylinder 90 is fixed to horizontal member 72 at the center of arcuate wheel member 64. The piston 92 of cylinder 90 is fixed to rectangular frame 79 of hold down clamp 78.

Although not shown, cylinder 88 is similarly attached to a similar horizontal support member 72 on arcuate wheel member 66. The piston associated with cylinder 88 is correspondingly attached to the opposite side of rectangular frame 79 of hold down clamp 78. Thus, when the cylinder pistons are in the extended position, hold down clamp 78 is raised, as shown by the dotted position of the hold down clamp in Figure 1. When fluid pressure is supplied to the top of cylinders 88 and 90, hold down clamp 78 is lowered, inserting nozzles 50 within openings 36 in the tanks 34 in the tank and pallet assembly 30 until clamping pads 84 and 86 engage the sidewalls of tanks 34 to firmly clamp the tank and pallet assembly within the carriage 20.

Vertical alignment of hold down clamp 78 is provided by vertical guide rods 96 and 98 which are extended vertically between horizontal frame member 72 and arcuate wheel member 64 as shown in FIG. 3. Riding on guide rods 96 and 98 are guide sleeves 102 and 104 which are integrally attached via gussets 100 to the hold down clamp 78. An identical configuration of components is provided on arcuate wheel member 66, not shown in FIGS. 3 and 4. Thus, motion of hold down clamp 78 is restricted to raising or lowering the frame along the vertical axis of the tank and pallet assembly resting on horizontal support platform 58.

Stationary frame 10 comprises two similar parallel base sections containing I-beams 12 and 14, transverse channel members 18 and 19, and frame covers 16. Cover 16 is broken away for clarity in the right side view of frame 10 shown in FIG. 1.

Wheel members 64 and 66 of the carriage thus described rest on two pairs of grooved rollers 110 and 112 which are rotatably mounted via bearings 122 to I-beams 12 and 14 of each base section of stationary frame 10. As shown best in FIG. 3, wheel 64 rests between idler roller 110 and drive roller 112. Drive roller 112 is connected to an identical drive roller, not shown, on the opposite side of stationary frame 10 which drives wheel member 66 via axle 114. Drive motor 120 is connected to drive rollers 112 via gear pulley 116 and drive pulley 118 mounted on a drive axle 114 via drive chain 121.

A sheet metal drain funnel assembly 130 is mounted between and within stationary frame 10. Wash water collected in drain funnel 130 is directed to drain pipe 132 which may go to any conventional drainage facility.

Figure 4:
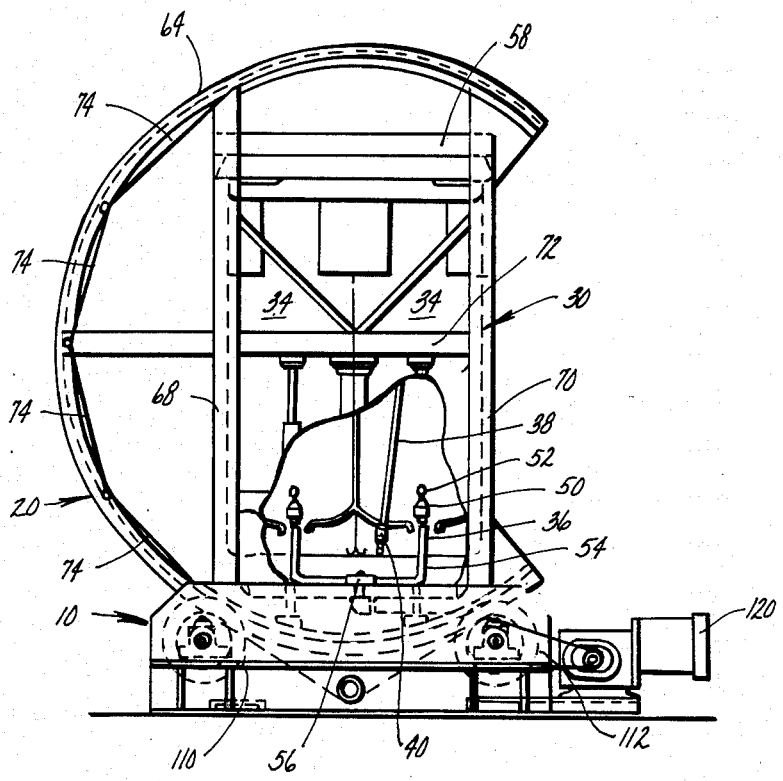
FIG. 4 is a side view of the wash station showing the carriage and tanks in the inverted washing position, with part of the carriage and tank and pallet assembly broken away to show the spray nozzles positioned within the tanks.

In FIG. 4 the wash station is shown in the inverted position during the washing operation. With the tank and pallet assembly 20 upside down, washing fluid is directed through flexible hose 55 and pipe 57 into spray header 56 which in turn directs the wash fluid through nozzle extensions 54, spray nozzles 50, and out spray heads 52 into the interior of the tanks 34. Wash fluid drains via opening 36 and also drains the tank discharge tanks 38 through quick disconnect couplings 40.

To prepare a tank and pallet assembly 30 for loading and washing, the fill and vent caps are removed from openings 36 in each tank 34, and quick disconnect fittings 40 are attached to tank discharge tubes 38 to allow the drainage during the wash operation. The assembly is then loaded on a fork truck and positioned through the open side of carriage 20 onto platform 58. Proper positioning is assured by the raised outer sides of support pads 60 and 62.

In operation, the tank and pallet assembly 30 is loaded through the opening in carriage 20 and placed on platform 58. Hold down clamp assembly 78 is then lowered to clamp the tank and pallet assembly 30 onto platform 58. The spray nozzles 50 are inserted into the containers as the hold down clamp 78 is lowered.

Once clamped, the wash station carriage 20 will then be rotated 180° to the inverted, wash position as shown in FIG. 4 and stop automatically. A five minute wash cycle is then started by opening a water valve, not shown. Water is fed via hose 55, pipe 57, wash header 56, nozzle extensions 54, and nozzles 50 to troll spray heads 52. The spray heads direct spray in all directions for a complete wash with 180° F. hot water. The water volume should be sufficient to flush the discharge tubes thoroughly. At the end of the wash cycle, the water valve is shut, letting the tank and pallet assembly drain completely. The operator then returns the wash station carriage 180° to the vertical upright position. The tank and pallet assembly is then unclamped to facilitate the removal of the assembly from the wash station. Approximate cycle time from the time the tank and pallet assembly is loaded into the wash station until the tank assembly is ready for unloading is approximately 8 minutes.

What is claimed is:

1. A wash station for receiving and washing tanks in a tank and pallet assembly consisting of a support pallet and a plurality of upright tanks supported on said pallet, each tank having an upper end with a central opening therein, said wash station comprising:

a stationary frame having two pairs of spaced and aligned rollers rotatably mounted thereon;

a carriage positioned above and resting on said rollers capable of receiving, supporting and clamping said tank and pallet assembly therein, said carriage including a pair of parallel arcuate carriage frame members arranged in a side-by-side spaced relation, transverse support members connected between said arcuate members for maintaining said arcuate members in said side-by-side relation and a horizontal platform secured to and extending between said arcuate carriage frame members for receiving and supporting said pallet;

said carriage having an open upright side between said arcuate members through which a tank and pallet assembly to be washed can be moved during loading and unloading;

a movable hold down frame positioned between said arcuate members, said hold down frame having a clamping pad and a plurality of spray nozzles mounted thereon, said hold down frame being movable to a position engaging said clamping pad with said upper ends of said tanks to clamp said tank and pallet assembly on said carriage, and inserting one of said nozzles within each of said tanks through said tank openings when said tanks are clamped on said carriage;

a drive motor mounted on said frame drivingly connected to one of said pairs of rollers for inverting said carriage; and means for directing washing fluid upwardly and outwardly through said spray nozzles within said tanks on said carriage when said carriage is rolled to a position inverting said tank and pallet assembly to wash the interior of said tanks.

* * * * *